United States Patent [19]

Segrist et al.

[11] Patent Number: 4,666,150

[45] Date of Patent: May 19, 1987

[54] DUMBELL POSITION RACK

[76] Inventors: Joseph S. Segrist, R.D. 5 Box 1132, Altoona, Pa. 16601; Michael D. Savino, 621 S. Carlisle La., Altoona, Pa. 16602

[21] Appl. No.: 803,476

[22] Filed: Dec. 2, 1985

[51] Int. Cl.[4] ..... A63B 13/00

[52] U.S. Cl. ..... 272/123; 211/13

[58] Field of Search ..... 272/122, 123; 248/149, 248/460; 211/13

[56] References Cited

U.S. PATENT DOCUMENTS

| | | | |
|---|---|---|---|
| 4,205,818 | 6/1980 | Lawler | 211/13 |
| 4,205,838 | 6/1980 | McIntosh | 272/123 |
| 4,412,678 | 11/1983 | Baynes | 272/123 |

FOREIGN PATENT DOCUMENTS

| | | | |
|---|---|---|---|
| 3022424 | 12/1981 | Fed. Rep. of Germany | 272/122 |
| 2232914 | 1/1975 | France | 248/149 |

*Primary Examiner*—Richard J. Apley
*Assistant Examiner*—J. Welsh

[57] ABSTRACT

A saddle mountable on telescoping tubular members or permanent tubular members that will support a complete dumbell cooperating with an open area centrally located throughout the dumbell receiving area of saddle to allow a hand to pass through on the return of the dumbell to the saddle. A guide positioned on saddle above open area that directs the plates or assembled weight of a dumbell away from the open area positioning the dumbell into its perfect resting area thus giving the user a unique device to support, receive and position a dumbell into a saddle as well as the capability of positioning a heavy pair of dumbells into a convenient liftable position to begin various exercises.

2 Claims, 5 Drawing Figures

DUMBELL POSITION RACK

BACKGROUND OF THE INVENTION (1) Field of the Invention

This invention relates to exercise equipment specifically to exercise equipment involving dumbells. It will permit an exerciser to support, receive and position into a convenient liftable position a complete dumbell commonly used.

(2) Discussion of the Prior Art

Prior structures of this type, have been for supporting, receiving and positioning barbells or plates of a barbell. For example, U.S. Pat. No. 4,412,678 and U.S. Pat. No. 4,205,838.

In U.S. Pat. No. 4,205,838 the exercise device is disclosed as having a pair of cradles for receiving the plates of a barbell.

In U.S. Pat. No. 4,412,678 the saddle is disclosed to receive a bar of a barbell.

The present invention discloses a dumbell position rack that will support, receive and also position a complete dumbell into a convenient liftable position to begin an exercise.

While performing certain exercises, The Prior Art of heavy dumbell exercising has usually been done with the aid of two training partners lifting the dumbells and each handing them to the exerciser to a convenient position where the exerciser could begin the exercise, or the exerciser struggled to get the heavy dumbells up to a convenient position to begin the exercise at the same time wasting energy jockeying the weight up. In many cases, the exerciser is limited to use only the amount of weight he can curl with his bicep since this is the muscle that is normally used to get the dumbell off the floor and into a convenient liftable position to begin the exercise. The restriction of only being able to use that you can curl up to a position to begin the exercise is a serious problem with many exercisers because the bicep is generally much weaker than the pectoral, deltoid and or tricep muscles commonly used in many exercises. The use of the lighter dumbells would impede the work as well as the growth of these larger and stronger muscles or muscle groups.

In many cases such as flat bench flyes, dumbell benches and incline flyes when the exerciser is training alone he must sit on the exercise bench then curl the dumbells up to his chest area then dangerously recline to the bench while at the same time continuing to hold these heavy dumbells thus causing instability to the exerciser while posing a danger of injury.

Another drawback of the Prior Art of picking the dumbells off the floor when training alone is the tendency of the exerciser to drop the dumbells at the completion of the exercise rather than risking the possibility of injury to the shoulder joints and muscles while trying to hold on to the dumbells while lowering them to the floor especially in a reclined position and after the muscles have just been exhausted exercising.

Dumbell work is used extensively by bodybuilders, powerlifters and athletes alike because of the many advantages it has over the barbell. The dumbell provides an opportunity for the user to exercise a muscle or group of muscles that couldn't be reached with the use of a barbell.

The barbell restricts the user in the training of certain parts of muscles or groups of muscles in that the bar of the barbell usually makes contact with a part of the body before it can go into a low range of movement i.e. the bench press one of the most popular and important exercises for upper body development as well as the test for a powerlifter's upper body strength. The bodybuilder may wish to really stretch his pectoral and deltoid muscles to give them more of a peak, but as he does his bench presses he must stop as the bar makes contact with his chest, stopping the range of motion there.

When the bodybuilder uses dumbells there isn't the problem of the bar restricting his range of motion therefore he can go well below chest level thus improving his overall physique.

A powerlifter may have the problem with the initial push of the bar off of his chest in the bench press this being called his "sticking point" but after he gets the bar past this so-called "sticking point", he has little trouble getting the bar up. This problem would constitute the lifter to train with heavy dumbells being brought below this "sticking point" or chest level thus developing a low range of power thus improving his strength.

The Dumbell Position Rack overcomes the drawbacks of the Prior Art in a highly novel manner in that it will support a heavy dumbell as well as receive it after the exercise is completed and it will position the dumbell in a convenient liftable position to begin the exercise thus eliminating the use of training partners, the restrictions on the weight of the dumbell when training alone, the wasted energy picking the dumbell up as well as providing safety to the exerciser, floor and equipment as described in the aforementioned.

After experiencing the drawbacks of the Prior Art of heavy dumbell training myself and realizing the widespread use and importance of heavy dumbell training by bodybuilders, powerlifters, athletes and others, I set out to create something to overcome these drawbacks.

SUMMARY OF THE INVENTION

It is an object of the present invention to provide a unique device for use with dumbells and their various dumbell exercises.

It is another object of the invention, when mounted on a verticle-type support it will support a complete dumbell commonly used, by use of a saddle-type device.

It is another object of the invention to receive a complete dumbell after the exercise by means of an open area provided through the saddle-like space that allows the hand of an exerciser to pass through on the return of a complete dumbell to saddle as well as providing an open area for a hand to grip the handle of the dumbell when beginning the exercise.

It is another object of the invention to guide the dumbell into its saddle-like space. This is accomplished with a unit mounted on the rearward directed portion of the saddle above said open area that directs the assembled weight or plates of dumbells when contact is made with the said unit to an area away from the said hand space and into the saddle-like space.

It is another object of the invention to provide a unique device of the aforementioned character which can be inexpensively manufactured by means of a process involving a minimum number of manufacturing jigs, fixtures and gussets but yet is capable of supporting, receiving and positioning the heaviest type of dumbell commonly used by powerlifters and also used by bodybuilders.

DESCRIPTION OF THE INVENTION

Figure 1:
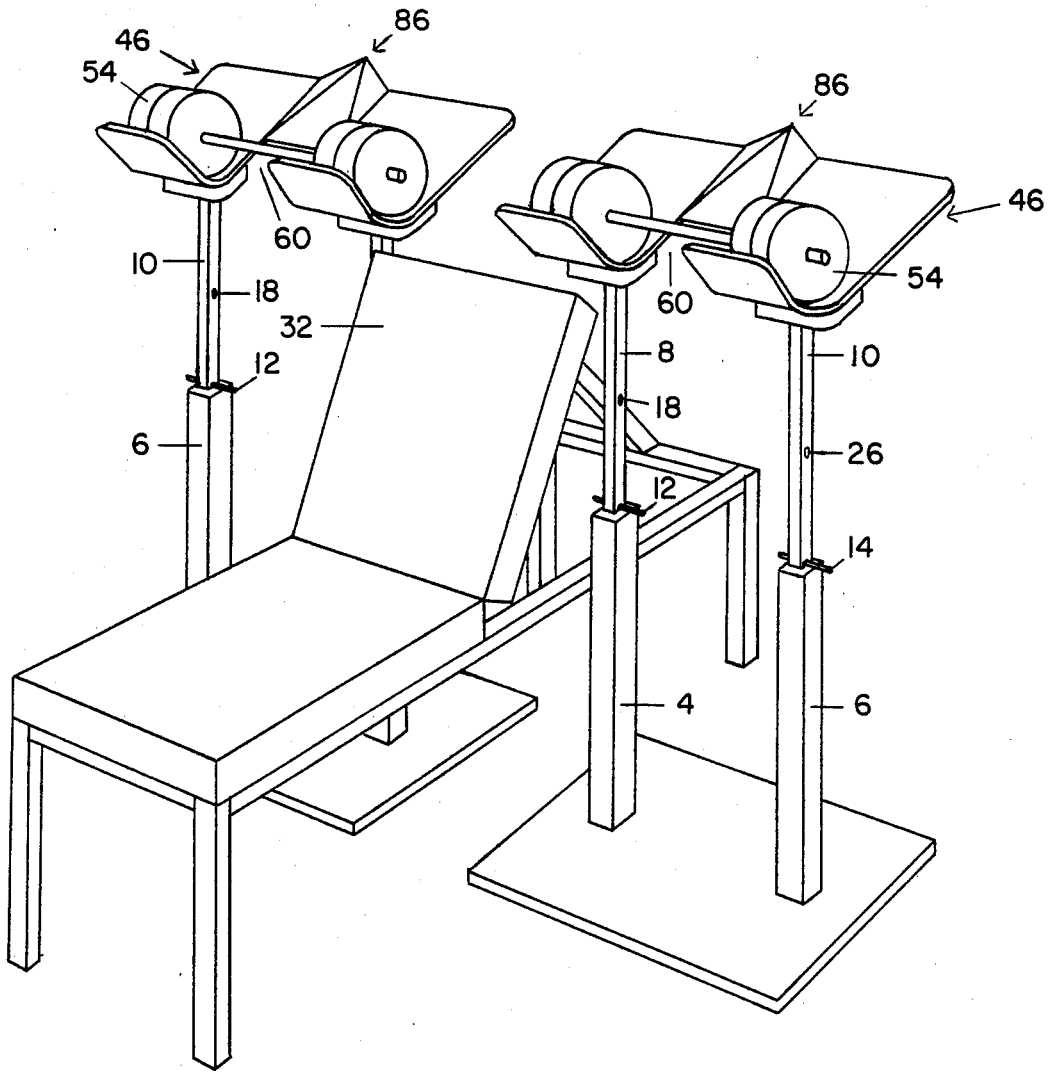
FIG. 1 is a perspective view of the present invention mounted on adjustable telescoping stands with a dumbell and plates thereon, one stationed on either side of an adjustable incline bench.

Referring particularly to FIG. 1 of the drawings, it will be seen that the invention is comprised of a saddle 46 to support a complete dumbell 54. A hand space 60 which allows the exerciser to grip the handle of the dumbell 54 when beginning the exercise as well as providing an open area for the hand to pass through the saddle on the return of the dumbell at the completion of the exercise. A guide 86 is mounted on the saddle 46 to direct the plates or assembled weight away from the hand space 60.

Figure 3:
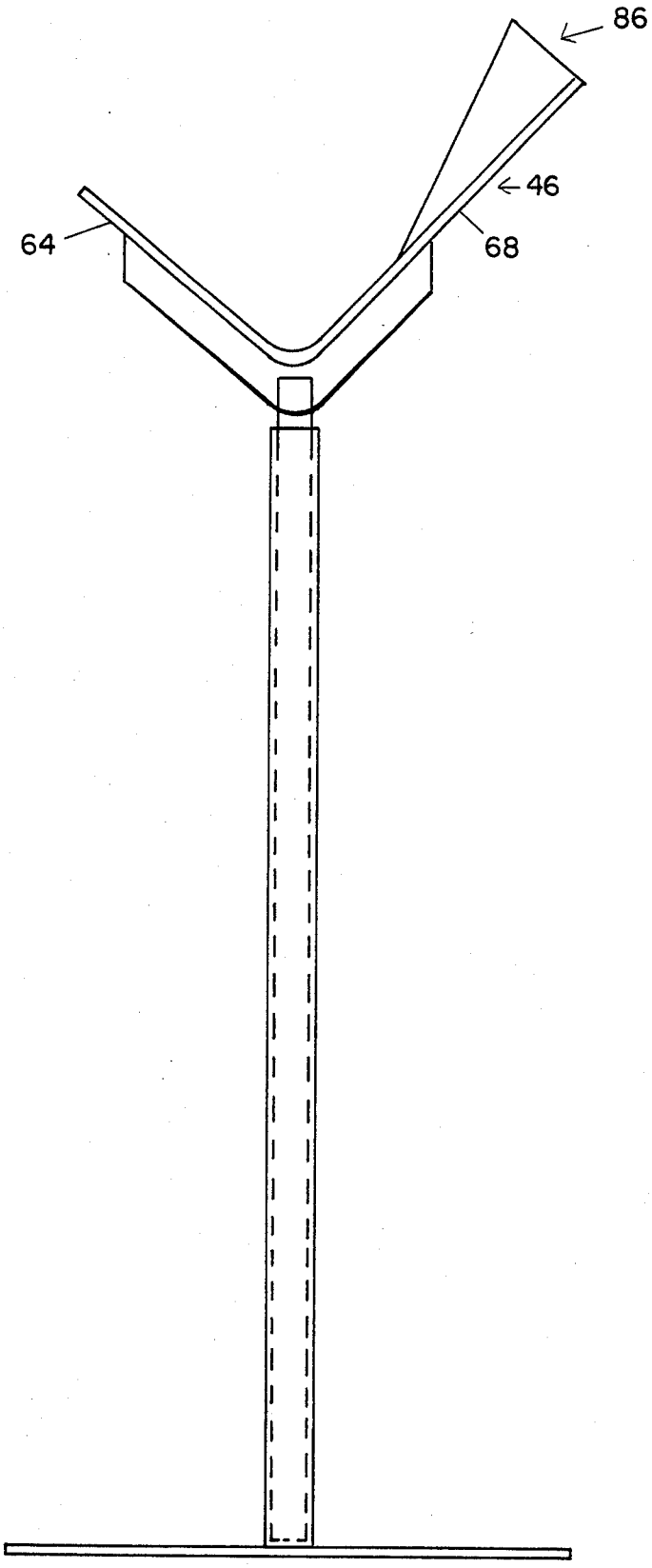
FIG. 3 is an enlarged side view of the invention mounted on an adjustable telescoping stand.
Figure 4:
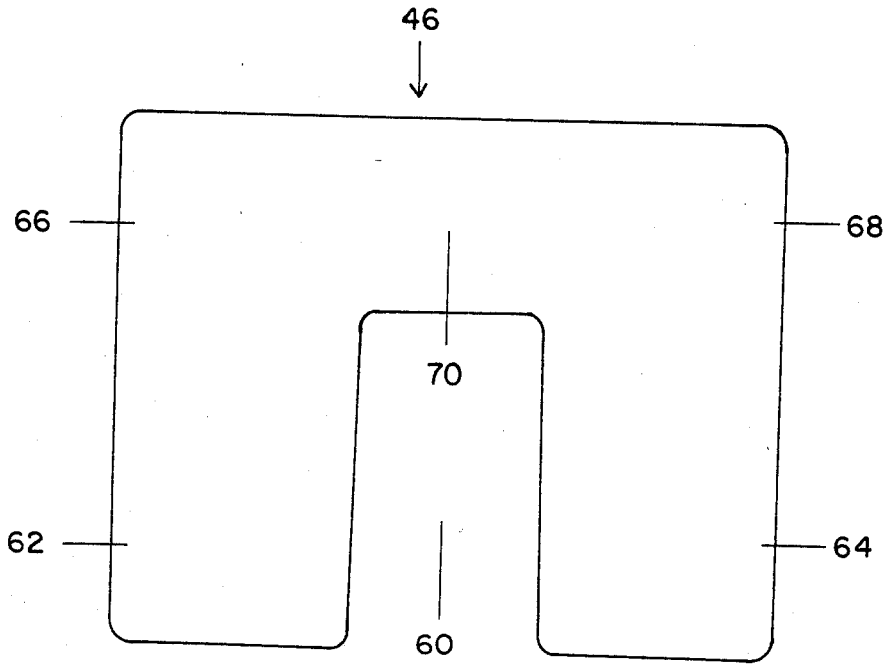
FIG. 4 is a top view of the saddle and hand space.

As best seen by FIGS. 3 and 4 the saddle 46 is comprised of a pair of first arms 62 and 64 that incline upwardly and forwardly, being approximately 6 inches long and 6½ inches wide and seperated by an open area of the same length being approximately 5 inches wide. Arms 66 and 68 incline upwardly and rearwardly, being approximately 3 inches long and 6½ inches wide also being seperated by an open area being approximately 5 inches wide and also being the same length of the arms 66 and 68. Arm 62 merges with arm 66 and arm 64 merges with arm 68 respectively to form an approximate 3½ inch arc at the merge and also creating a substantially U-shaped saddle-like space to support the weight plate portion of a dumbell 54.

Figure 2:
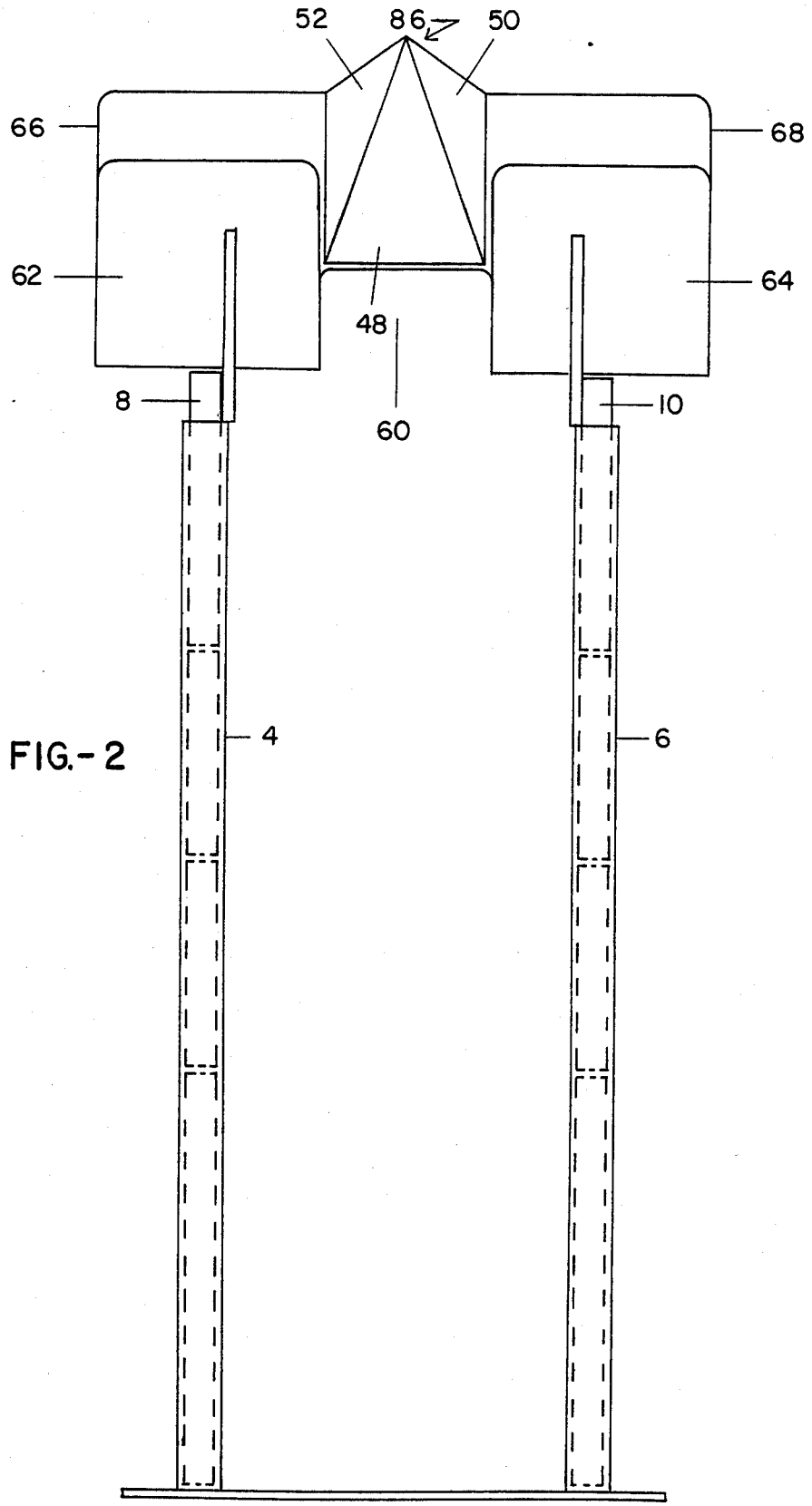
FIG. 2 is an enlarged fronted view of the invention mounted on an adjustable telescoping stand.

As best seen by FIGS. 2 and 4, the said open area between arms 62 and 64 merge with the said open area between arms 66 and 68 to create the hand space 60 that gives the exerciser easy accessibility to grip the handle of a dumbell 54 while it is in its said saddle-like space before the exercise as well as providing an open area for the hand to pass through the saddle 46 on the return of the dumbell 54 to its said saddle-like space.

As best seen by FIG. 4 the saddle 46 has a solid portion 70 that begins at the rearward end of the arms 66 and 68 and the rearward solid edge above the hand space 60 created by the discontinuation of the hand space 60 coacting without joints to incline upwardly and rearwardly. The solid portion 70 stops the dumbell on its rearward return to the saddle.

Figure 5:
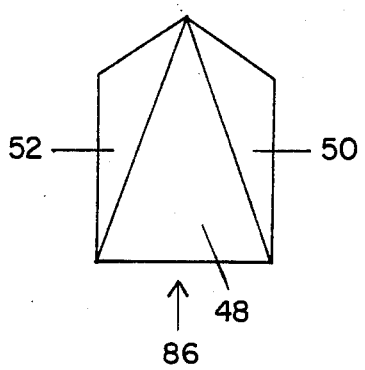
FIG. 5 is a frontal view of the guide.

Referring to FIGS. 2, 4, and 5 the saddle 46 has a guide member 86 mounted on the solid portion 70 of the saddle 4 above the rearward edge of hand space 60. The guide is comprised of a trapezoid 48 with two equilateral sides 50 and 52 each being triangular. The bottom of the trapezoid 48 being approximately 5 inches wide is secured flush to the solid portion 70 at a point centrally located above the rearward portion of the hand space 60. As the trapezoid becomes narrower it also projects forwardly. Respectively, leaving a 1 inch width at the top of the trapezoid as well as an approximate 3½ inch distance between solid portion 70 and said top of trapezoid 48. The triangular sides 50 and 52 are each molded on the trapezoid 48 one on each side of the trapezoid. The longest side of the triangular side 50 is molded on one side of the trapezoid and the other longest side of the other triangular side 52 being molded on the other side of the trapezoid 48. As the trapezoid 48 becomes narrower as it rises and protrudes forwardly, respectively the rest of the triangular sides 50 and 52 protrude outwardly and rearwardly, respectively to reach and be secured to an imaginary straight verticle line drawn from the corners of the said bottom part of the trapezoid. When the dumbell 54 is returned to the saddle 46 at the completion of an exercise, the dumbell 54 is brought back in a rearward motion towards the solid portion 70, the assembled weight or plates of a dumbell when off track of their saddle-like space will make contact with the sides 50 and 52 of the guide 86. Since each of the sides angle away from trapezoid outwardly and rearwardly to a width as great as the hand space 60 it will direct the plates or assembled weight of the dumbell 54 away from the hand space 60.

The Dumbell Position Rack could be mounted various ways without losing the scope of the invention. It could be mounted on fixed verticle tubular members such as a flat dumbell bench or on adjustable telescoping verticle members.

For the purpose of showing the widest range of capabilities of the invention, the dumbell position rack is shown (FIG. 1) as being mounted on portable adjustable telescoping tubular members located adjacent to an adjustable incline bench. The portable stands and the bench are not parts of the present invention.

It can be seen in FIG. 1 that the adjustable incline portion 32 of the bench could be positioned at various positions from a 0 degree angle to a 90 degree angle depending on the exercise desired to be performed, at the same time the Dumbell Position Rack is secured to a pair of verticle supports 8 and 10 telescopingly positioned inside verticle tubular members 4 and 6 respectively. As the degree of the incline portion 32 of the bench is adjusted according to the exercise desired, so may the Dumbell Position Rack by raising the rack along with its secured verticle supports 8 and 10 to a heighth that gives the exerciser his most convenient position for that exercise. Bolts 12 and 14 are then inserted through the plurarity of aperatures 26 and 18 located on the verticle supports 8 and 10 respectively.

Although but one embodiment of the present invention has been illustrated and described, it will be apparent to those skilled in the art that various changes and modifications may be made therein without departing from the spirit of the invention.

Having thus described my invention what I claim is:

1. An exercise weight support stand for supporting a dumbell, said dumbell including two weight plate portions separated and connected by a user engaging bar, and said support stand comprising:

a base, a pair of verticallly adjustable support legs rigidly mounted to said base, a pair of spaced apart saddles for supporting said weight plate portions of said dumbell mounted one on each support leg, each of said saddles including a front arm extending upwardly and forwardly and being connected to a rear arm extending upwardly and rearwardly so as to form a substantially U-shaped weight plate support surface, the rear half of each of said rear arms being connected to one another by a rigid guide member, with the front halves of said rear arms remaining open to allow a users hand to pass through for grasping said engaging bar, said guide member having a triangular projecting upper surface with its apex in the rear and said upper surface sloping downward from the apex towards each adjacent saddle and the front, whereby said guide member directs the weight plate portions of said dumbell into said pair of saddles.

2. The device of claim 1, wherein the pair of saddles and the guide member are formed in one unitary piece.

* * * * *